United States Patent [19]

Wuestner

[11] Patent Number: 4,905,910

[45] Date of Patent: Mar. 6, 1990

[54] DOUBLE ROLL MACHINE SUCH AS, FOR EXAMPLE, A ROLL PRESS

[75] Inventor: Helmut Wuestner, Cologne, Fed. Rep. of Germany

[73] Assignee: Klöckner-Humboldt-Deutz Aktiengesellschaft, Fed. Rep. of Germany

[21] Appl. No.: 247,669

[22] Filed: Sep. 22, 1988

[30] Foreign Application Priority Data

Sep. 23, 1987 [DE] Fed. Rep. of Germany ..... 3731934

[51] Int. Cl.[4] ..... B02C 4/42

[52] U.S. Cl. ..... 241/101.2; 241/230

[58] Field of Search ..... 241/101.2, 227, 229–236; 74/661, 665 R

[56] References Cited

U.S. PATENT DOCUMENTS 3,328,976 7/1967 Shoemaker et al. ..... 74/665 R
3,576,106 4/1971 Nowicki ..... 74/661 X
3,734,257 5/1973 Eastcott et al. ..... 74/661 X
4,703,897 11/1987 Beisner et al. ..... 241/24

FOREIGN PATENT DOCUMENTS 876647 9/1961 United Kingdom ..... 74/661

*Primary Examiner*—Joseph M. Gorski
*Attorney, Agent, or Firm*—Hill, Van Santen, Steadman & Simpson

[57] ABSTRACT

In a double roll machine such as roller presses for extremely high drive power requirements without having to employ heavy and bulky drive motors with intermediate gears operating under the principles of product bed pressing, both long ends of both rollers of a double roll machine are constructed as drive journals and all four drive journals each are driven by a separate drive motor, particularly by a slip-on gearing, i.e., that the two rollers of the double roll machine be driven with a total of four drive motors with resistant and shock torque shared equally at both ends of the rollers.

6 Claims, 1 Drawing Sheet

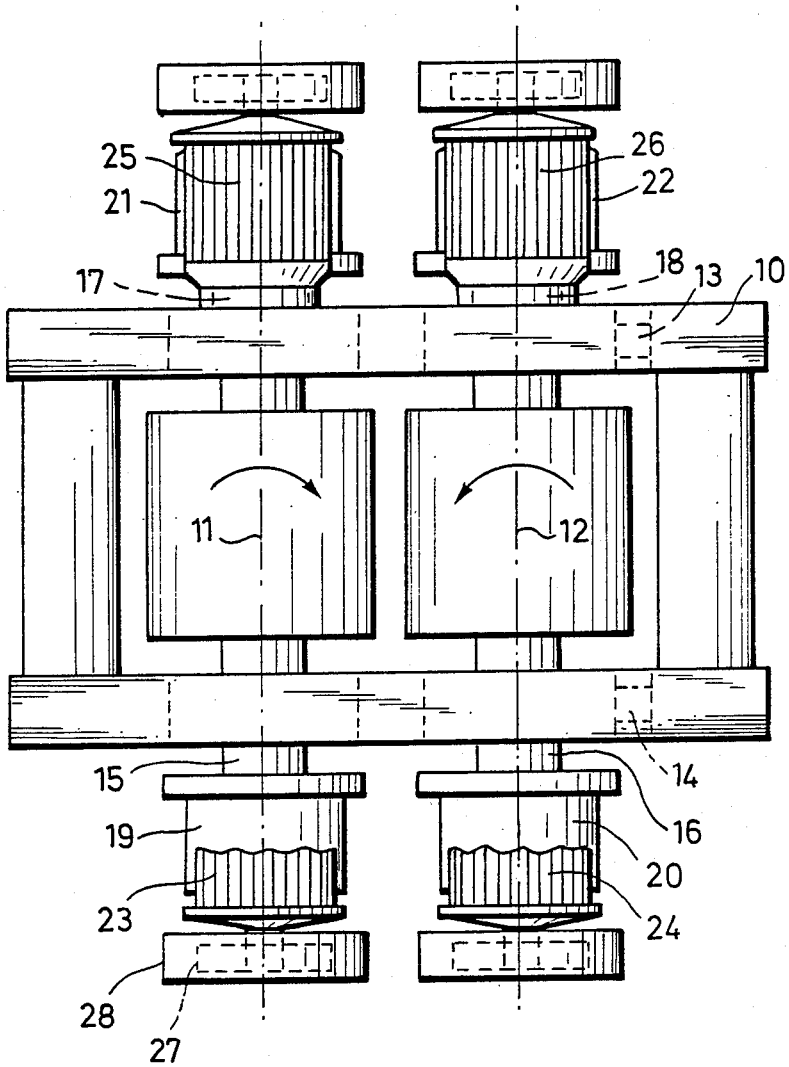
25
21
26
22
17
18
13
10
11
12
15
14
19
16
20
23
24
28
27

DOUBLE ROLL MACHINE SUCH AS, FOR EXAMPLE, A ROLL PRESS

BACKGROUND OF THE INVENTION

The invention relates to a double roll machine such as, for example, a roll press which comprises two rotatably seated rollers that are rotatable in opposite directions and are connected to a rotary drive.

Roll presses or roller mills comprise two rotatably seated rollers rotating in opposite directions that form a nip between them in which granular solid material is subjected to a pressure stressing. The four roller bearings are integrated in rectangular pillow blocks that respectively rest on a guideway of the lower part of the machine frame. One of the two rollers is usually constructed as a fixed roller that is directly supported against an end wall of the machine frame, whereas the other roller is constructed as a movable roller and is supported against the hydraulic cylinder of a hydro-pneumatic system by two blocks. The pressing power of the roller being exerted and the adjustment of the width of the nip are undertaken with this hydro-pneumatic system.

In a known roll press of this species (brochure "Rollenpresse" No. 11-304d of KHD Humboldt Wedag AG), the two rollers each comprise a driving journal projecting out of the machine frame, and a slip-on gearing constructed as a planetary gearing is slipped onto the two driving journals lying diagonally opposite one another. An electric motor that transmits its torque onto the respective slip-on gearing using V-belts for a rotary drive of the respective roller is situated on the upper side of the slip-on gearing. Every roller is thus driven by one electric motor and a total of two drive motors are present in the roller press. This drive arrangement for the roller press can be technically suitable up to a drive power of about 500 kW per motor. Given a requirement for even higher drive powers, the known drive arrangement can present problems insofar as the motors become so large that they can no longer be accommodated in the space above the slip-on gearings and because the V-belt forces that occur and that can deteriorate, the motor bearing requires an intermediate gear that cannot be built on the slip-on gearings because of its volume and weight.

An object of the invention is to create a double roll machine such as, for example, a roll press or roller mill that is suitable for high throughput powers and high roller pressing powers as well as for high drive power requirements without having to have recourse to drive motors comprising an intermediate gear.

A further object of the invention is to provide an improved method and apparatus for the continuous pressure comminution of brittle grinding stock utilizing the principles of grain comminution and product bed comminution in the same roller press and improving the operation of the press in accordance with these principles by a unique drive arrangement.

FEATURES OF THE INVENTION

The concepts of unit grain comminution and product bed comminution are reviewed and features disclosed in issued U.S. Pat. No. 4,703,897 issued Nov. 3, 1987. Developments in the field of roller press crushing are discussed therein and the disclosure of Pat. No. 4,703,897 is incorporated herein by reference.

The rollers in the double roller machine of the invention comprise a driving journal at not only their one respective end but both long ends of both rollers are constructed as drive journals, and all four drive journals are connected to a separate drive motor, i.e., every roller is in communication with two drives and a total of four drive motors are present. The drive power of the rotary drive of the double roll machine can be increased without having to make the individual drive motors so large that separate intermediate gears would be required for them. In other words, the drive power of the double roll of the invention is provided by four motors instead of the previous two motors, with the result that the individual drive motor can be built far smaller than was hitherto the case given employment of only two drive motors. Every individual drive motor is therefore constructed relatively small, so that a specific feature of the invention is a double roll machine wherein a respective slip-on gearing is slipped onto all four drive journals of the rollers, and a comparatively small drive motor, particularly an electric motor, is constructed on each of the four slip-on gearings, this drive motor operating without an intermediate gear and having adequate space on the upper side of the slip-on gearing that is constructed as a planetary gearing. Instead of being driven by an electric motor, each of the four drive journals can also be driven by a separate hydraulic motor, i.e., the double roll machine of the invention can also be driven by a total of four hydraulic motors.

Other objects, advantages and features will become more apparent with the teachings of the principles of the invention in connection with the disclosure of the preferred embodiment thereof in the specification, claims and drawings, in which:

DESCRIPTION OF THE DRAWINGS

The single FIGURE of the drawings is a plan view of a roller press structure embodying the principles of the present invention.

DESCRIPTION OF THE PREFERRED EMBODIMENTS

The drawing somewhat schematically shows a plan view of the double roll machine of the invention, for example, a roller press. Two oppositely rotating rollers 11, 12 are rotatably seated in a machine frame 10. One roller 11 is constructed as a fixed roller and is directly supported on the machine frame 10. The other roller 12 is constructed as a movable roller that is supported against hydraulic pressing cylinders 13 and 14 of a hydro-pneumatic system with which the pressing power for stressing the material situated in the nip is exerted.

The rollers are arranged to have a varying nip width therebetween and the rollers have a diameter greater than 750 mm. In operation, a grinding stock is delivered to the nip where a substantial portion has a grain size larger than the width of the nip. A force must be applied to the rollers to obtain a crushing force in the nip in excess of 2 tons per centimeter roll length and thereby the stock in the nip is subjected to unit grain comminution and to product bed comminution where the nip has its smallest width. This results in the inducement of incipient or inherent cracks in the material which cause disintegration of the material when the resultant scabs obtained from the roller press are further handled such as in a ball mill. With a structure of this dimension wherein the grain size of the stock is up to 100 mm, the half nip angle of the unit grain comminution region defined by the angle between the roller axis and the portion of the stock at which unit grain comminution begins is in the range of 10° to 30°, and the half nip angle between the product bed comminution defined by the angle between the roller axis and the portion of the stock at which product bed comminution begins is in the range of 3° to 15°. The material so subjected to product bed comminution is further handled such as by a tube mill which is connected to receive the delivery of the comminuted stock from the roller press.

In accordance with the invention, the two long ends of both rollers 11, 12 are constructed as driving journals 15 through 18 and each of the four driving journals is connected to a separate drive motor. In accord with the exemplary embodiment, a respective slip-on gearing 19 through 22 is thereby slipped onto each of the four driving journals and connected such as by keys or splines. This slip-on gearing is constructed as a planetary gearing which functions a reducing drive. A drive motor is built on the upper side of each of the slip-on gearings 19 through 22, illustrated as electric motors 23 through 26 in the exemplary embodiment of the drawing. Set forth with reference to the example of the electric motor 23 is that a pinion 27 thereof within a protective housing 28 drives the roller 11 by V-belts and by the slip-on gearing 19 and the driving journals 15. The other electric motors likewise transmit their torques onto the two rollers 11 and 12. The electric motors 23, 24 are shown in section in order to allow the slip-on gearings 19, 20 arranged therebelow to be seen with greater clarity.

Due to the high forces which are present in the nip with product bed comminution, substantial torque resistance is encountered and shock load occurs as the product passes through the nip. Particularly with a roller press of substantial length, if a drive is adopted which drives each roll, or only one of the rolls, from one end, the torque resistance from the end of the rollers where they are not driven must be transmitted throughout the full length of the rollers possibly causing twisting and uneven rotation.

It has been found that improved product bed comminution occurs utilizing the principles of the present invention and the theory by which this occurs, and by which the inventor is not to be bound is that by driving both of the rolls and driving them from both ends, the resistant torque or twist on the rollers is transmitted through only half of the length of each of the rollers instead of the full length as is the case where the driving occurs on one end. By transmitting the torque for only a half length, this reduces the very minor alterations in speed which can occur due to the twisting of the roll with resistant torque as the material passes through the nip. Also, vibratory effects set up by the grinding are thought to be reduced by driving the rolls at both ends thereby increasing the consistency in grinding in the roller press and particularly using product bed comminution principles. The foregoing is significant in that both unit grain comminution and product bed comminution are carried out in the roller gap of the same roller mill so that as material particles of varying width enter the nip, the two grinding effects are improved by a drive at opposite ends of the rollers.

Since a total of four electric motors 23 through 26 are present in the double roll machine of the invention for the rotary drive of the two rollers 11, 12, these electric motors are constructed relatively small, so that they have adequate space in order to be constructed on the upper sides of the slip-on gearings 19 through 22. The drive power per electric motor can thus be kept below about 500 kW, so that separate intermediate gears are not required. The two rollers 11, 12 can also be driven by four hydraulic motors instead of being driven by four electric motors 23 through 26.

The torque reaction generated by the slip-on gearings 19 through 22 can be diverted into the machine housing by a torque support hinged to the housing of each and every slip-on gearing or the slip-on gearings can be arranged side-by-side adjacent to one another and can be connected to one another by a common torque support arranged roughly horizontally transversely to the nip and by which the reaction moment of two neighboring slip-on gearings is oppositely absorbed.

For operation in accordance with the principles of product bed pressing, the rolls are preferably driven at a circumferential speed in the range of 0.31 to 0.43 meters per second.

The invention can be employed with particular advantage in product bed comminution of brittle grinding stock in the nip of a high-pressure roll press that presses the grinding stock in a bulk fill or product bed with extremely high roller pressing powers of, for example, greater than 8 t/cm of roller length without having to employ heavy and bulky drive motors with intermediate gears.

I claim as my invention:

1. A mechanism for the continuous pressure comminution of brittle grinding stock, which comprises in combination:

a roll jaw crusher having a pair of driven rollers having a controllable variable nip therebetween each roller having a rotational axis and each roller having a diameter greater than 750 mm, the nip between the rollers being adapted to receive a grinding stock in which a substantial portion thereof has a grain size larger than a width of the nip;

means applying a force to said rollers obtaining a crushing force in the nip in excess of 2 tons per centimeter of roller length;

the diameter of the rollers, the spacing of the rollers and the speed of the rollers being such that said stock entering the nip is subjected to unit grain comminution in that portion of the nip which is relatively width and to product bed comminution where the nip has the smallest width; and a power drive unit located at each end of each of said rollers and connected to each end of each of said rollers driving the rollers in rotation in opposite rotational direction so that grinding stock passes through the nip thereof and so that power is delivered substantially uniformly to each of the rollers at each end thereof with grinding torque being delivered from both ends of each of the rollers from the ends to the center thereof.

2. A mechanism for the continuous pressure comminution of brittle grinding stock constructed in accordance with claim 1:

wherein each of the rollers having a journal extending from each end and the power drive units each include a drive motor driving the rollers through slip-on gearings connected to each journal.

3. A mechanism for the continuous pressure comminution of brittle grinding stock constructed in accordance with claim 1:

wherein each of the power drive units at each end of the rollers are drive by a separate hydraulic motor.

4. A mechanism for the continuous pressure comminution of brittle grinding stock constructed in accordance with claim 1:

wherein the power drive unit at each end of each roller includes an electric motor concentrically positioned relative to the rotational axis of the roller.

5. A mechanism for the continuous pressure comminution of brittle grinding stock constructed in accordance with claim 4:

wherein the drive units each include a drive motor driving rollers through a planetary gearing.

6. A mechanism for the continuous pressure comminution of brittle grinding stock constructed in accordance with claim 1:

wherein one of the rollers is mounted in fixed bearings and the other roller is mounted in movable bearings movable in a radial direction relative to the rotational axis of said one roller to control the size of the nip.

* * * * *